US011130215B2

(12) United States Patent
Gupte et al.

(10) Patent No.: US 11,130,215 B2
(45) Date of Patent: Sep. 28, 2021

(54) METHODS AND SYSTEMS FOR INCREASING THE EFFICIENCY OF A REMOTE WRENCH

(71) Applicant: Snap-on Incorporated, Kenosha, WI (US)

(72) Inventors: Anup A. Gupte, Kenosha, WI (US); Daniel M. Eggert, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 15/938,149

(22) Filed: Mar. 28, 2018

(65) Prior Publication Data

US 2018/0215017 A1 Aug. 2, 2018

Related U.S. Application Data

(63) Continuation of application No. 15/005,199, filed on Jan. 25, 2016, now Pat. No. 9,969,067.

(60) Provisional application No. 62/117,008, filed on Feb. 17, 2015.

(51) Int. Cl.
*B25B 17/00* (2006.01)
*B25B 13/48* (2006.01)

(52) U.S. Cl.
CPC ..... *B25B 17/00* (2013.01); *B25B 13/481* (2013.01)

(58) Field of Classification Search
CPC ..... B25B 17/00; B25B 13/481
USPC ..... 81/57.24
See application file for complete search history.

(56) References Cited

U.S. PATENT DOCUMENTS

| | | | | |
|---|---|---|---|---|
| 173,467 | A | 2/1876 | Hill | |
| 603,156 | A | 4/1898 | Spengler | |
| 793,729 | A | 7/1905 | Mahlen | |
| 807,481 | A * | 12/1905 | Miller | B23Q 3/15706 144/93.1 |
| 1,442,536 | A * | 1/1923 | Olhasso | B25B 21/00 81/57.24 |
| 1,481,652 | A | 1/1924 | Nixon | |
| 1,494,200 | A | 5/1924 | Waters | |
| 2,073,903 | A | 3/1937 | O'Neil | |

(Continued)

FOREIGN PATENT DOCUMENTS

| | | |
|---|---|---|
| CN | 203557319 | 4/2014 |
| DE | 102008043995 | 5/2010 |

(Continued)

OTHER PUBLICATIONS

Chinese Fourth Office Action for Application No. 2018122802315090 dated Jan. 3, 2019, 6 pages, Not in English.

(Continued)

*Primary Examiner* — Hadi Shakeri
(74) *Attorney, Agent, or Firm* — Seyfarth Shaw LLP

(57) ABSTRACT

Methods and systems for increasing the efficiency of a remote wrench. The remote wrench can include a flexible plate within the tool housing or as part of the housing that is more flexible than the rigid housing in conventional remote wrenches that has been shown to limit efficiency. Additionally, a fixed support and a base can be provided that are collectively capable of being coupled to the remote wrench, preferably at the flexible plate, to increase efficiency. The remote wrench operation is therefore improved by reducing inefficiencies and providing a maximum torque output.

15 Claims, 6 Drawing Sheets

(56) References Cited

U.S. PATENT DOCUMENTS

| | | | | | |
|---|---|---|---|---|---|
| 2,235,192 | A * | 3/1941 | Bailey | B25B 21/00 | 475/265 |
| 2,436,650 | A | 2/1948 | Killmer | | |
| 2,572,297 | A | 10/1951 | Able | | |
| 2,817,256 | A | 12/1957 | Malone et al. | | |
| 2,825,252 | A * | 3/1958 | Roberts | B25B 21/002 | 81/57.14 |
| 2,830,479 | A | 4/1958 | Finn | | |
| 3,138,983 | A | 6/1964 | Frizzell | | |
| 3,232,149 | A | 2/1966 | Duchesne | | |
| 3,602,071 | A * | 8/1971 | Juhasz | B25B 21/002 | 81/57.14 |
| 3,620,105 | A * | 11/1971 | Batten | B25B 21/002 | 81/57.14 |
| 3,992,964 | A | 11/1976 | Osmond | | |
| 4,231,271 | A | 11/1980 | Yamada | | |
| 4,287,795 | A | 9/1981 | Curtiss | | |
| 5,226,906 | A * | 7/1993 | Crombie | A61B 17/8875 | 606/104 |
| 5,586,474 | A | 12/1996 | Lund | | |
| 5,732,605 | A | 3/1998 | Mann | | |
| 5,924,442 | A * | 7/1999 | Vorosmarti | F16K 17/36 | 137/315.35 |
| 5,927,156 | A * | 7/1999 | Landwehr, III | B25B 17/00 | 81/57.3 |
| 5,974,913 | A | 11/1999 | Von Rotz et al. | | |
| 6,244,138 | B1 | 6/2001 | Campbell | | |
| 6,295,895 | B1 | 10/2001 | Hejninger | | |
| 6,742,417 | B2 | 6/2004 | Ha | | |
| 6,945,139 | B1 * | 9/2005 | Johnson | B25B 13/481 | 81/177.2 |
| 7,062,992 | B2 * | 6/2006 | Spirer | B25B 13/463 | 81/57.3 |
| 9,199,361 | B2 | 12/2015 | Taylor | | |
| 9,676,084 | B2 * | 6/2017 | Noel | B25B 17/02 | |
| 2005/0166714 | A1 | 8/2005 | Fowler | | |
| 2011/0000342 | A1 | 1/2011 | Lambert et al. | | |
| 2013/0047432 | A1 | 2/2013 | Novkov | | |
| 2013/0233131 | A1 * | 9/2013 | Badiali | B25B 21/007 | 81/57.3 |

FOREIGN PATENT DOCUMENTS

| | | |
|---|---|---|
| EP | 2660008 | 11/2013 |
| GB | 2461576 | 1/2010 |
| WO | 0168325 | 9/2001 |

OTHER PUBLICATIONS

Canadian Intellectual Property Office Examiner's Report dated Mar. 13, 2017; 3 pages.

State Intellectual Property Office of P.R. China, The First Office Action, dated Apr. 20, 2017; 10 pages.

United Kingdom Intellectual Property Office Combined Search and Examination Report, dated Jun. 20, 2016; 7 pages.

Australian Patent Examination Report No. 1, dated Aug. 5, 2016; 4 pages.

Chinese Third Office Action for Application No. 201610088637.X dated May 28, 2018; 3 pages.

* cited by examiner

METHODS AND SYSTEMS FOR INCREASING THE EFFICIENCY OF A REMOTE WRENCH

CROSS REFERENCE TO RELATED APPLICATIONS

The present application is a continuation of and claims priority to U.S. patent application Ser. No. 15/005,199, filed on Jan. 25, 2016, entitled Methods and Systems for Increasing the Efficiency of a Remote Wrench, which claims priority to U.S. Provisional Patent Application No. 62/117,008, filed on Feb. 17, 2015, entitled Methods and Systems for Increasing the Efficiency of a Remote Wrench, the contents of which are incorporated by reference herein in their entirety.

TECHNICAL FIELD OF THE INVENTION

The present application relates generally to accessories or additions for remote or extension wrenches. More particularly, the present application relates to methods and systems for increasing the efficiency of a remote or extension wrench.

BACKGROUND OF THE INVENTION

Remote or extension wrenches are commonly used to gain access to difficult to access places in a vehicle or other workspace. Remote wrenches include an input on a first end for receiving torque from a tool (e.g., a ratchet or torque wrench), and an output on a distal, opposing second end for transferring the torque to a work piece (e.g., nut or bolt) in a difficult to access or otherwise inaccessible area. The input and output are typically operably coupled by a chain-and-sprocket system or gear train to transfer the torque between the input and output, efficiently connecting the remotely located tool to the work piece.

Like many mechanical systems, remote wrenches are not 100 percent efficient. For example, using a remote wrench decreases the amount of torque applied by a torque wrench to a work piece because the remote wrench includes frictional or other inefficiencies that limit the application of torque through the output. Accordingly, while a remote wrench can assist a user to reach a difficult to access area, conventional remote wrenches include the drawback of decreasing the amount of torque applied to the work piece, relative to the input torque, due to the inherent inefficiency of the remote wrench. Also, when using a ratchet wrench to apply input torque, the user must rotate the ratchet wrench while it remains connected to the remote wrench. The remote wrench may be located at an angle to the ratchet wrench such that it is difficult to substantially rotate the ratchet wrench without holding or otherwise supporting the remote wrench. This, too, creates inefficiencies in the torque transfer process.

SUMMARY OF THE INVENTION

The present invention broadly comprises methods and systems for increasing the torque transfer efficiency of a remote or extension wrench. In an embodiment, the invention includes a housing with a flexible plate for housing the internal components of the remote wrench, rather than a rigid housing, which has been known to limit torque transfer efficiency of the remote wrench operation. In another embodiment, the present invention broadly includes a fixed support and base collectively capable of being coupled to the remote wrench, preferably at a flexible plate, to increase torque transfer efficiency.

The inventors of the present invention discovered that rigid outer housings reduce the torque transfer efficiency of the remote wrench during operation. Torque transfer efficiency can be additionally improved by including a support and base coupled to the flexible plate, with the support acting as a cantilever beam and reducing loss of torque transfer from the input to the output. Another benefit of having a flexible housing is there is a reduction in the load bore by the torque transfer system (e.g., chain or gear), which subsequently increases the wrench ultimate strength and fatigue life.

In an embodiment, the present invention broadly comprises a tool including a housing having first and second ends and first and second housing portions. The first housing portion has a first stiffness and the second housing portion has a second stiffness greater than the first stiffness. Also included is an input coupled to the housing and adapted to receive torque, and an output coupled to the housing and adapted to receive torque from the input and transfer the torque to a work piece, and a support coupled to the first portion between the first and second ends, the support extending perpendicularly from the first portion.

In another embodiment, the present invention broadly includes a method of applying torque to a work piece, including providing a tool having a housing with a first portion having a first stiffness and a second portion having a second stiffness greater than the first stiffness, the tool further including an input adapted to receive a torque and transfer the torque to an output, the output further adapted to transfer the torque, coupling a support to the first portion, and applying the torque to the input and allowing the torque to be transferred from the output.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
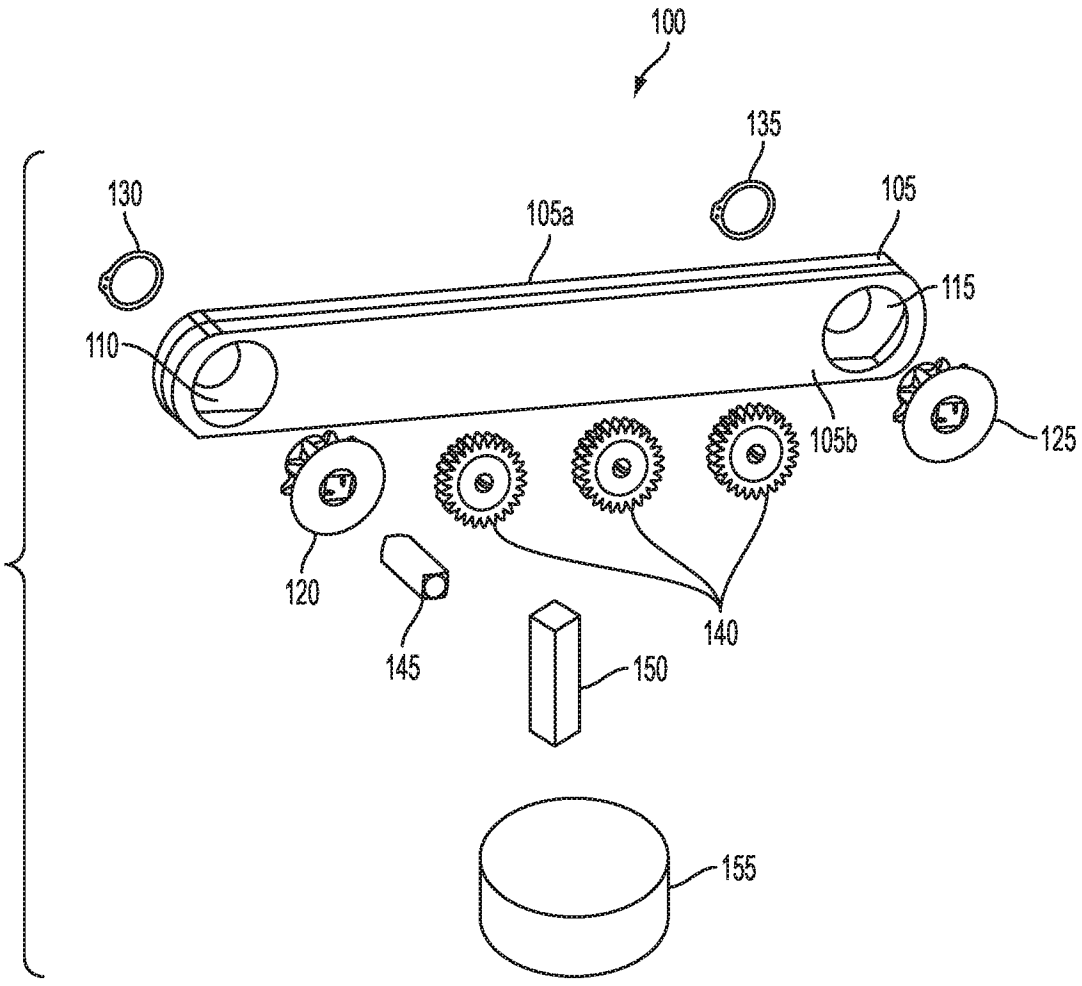
FIG. 1 is an exploded, side perspective view of a remote wrench according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention, and is not intended to limit the broad aspect of the invention to any specific embodiments illustrated or disclosed. As used herein, the term "present invention" is not intended to limit the scope of the claimed invention, and is instead a term used to discuss exemplary embodiments of the invention for explanatory purposes only.

The present invention broadly comprises methods and structures for increasing remote or extension wrench efficiency. In an embodiment, the remote wrench can include a housing with a flexible plate located on an outer surface of the housing. The flexible plate is in contrast to the rigid housing of conventional remote wrenches, known to limit efficiency of the remote wrench operation. The remote wrench can also include a fixed support and base that are cooperatively capable of being coupled to the remote wrench, preferably at the flexible plate, to increase torque transfer efficiency. The flexible plate and/or the support and base mechanism improve torque transfer efficiency over conventional remote wrench configurations that are coupled to a more rigid support. The torque transfer efficiency of the remote wrench of the present invention is therefore improved over the conventional remote wrench.

Referring to FIG. 1, in an embodiment, a tool 100 includes a housing 105 with a first portion 105*a* and a second portion 105*b* coupled together by known fastening means, such as, for example, fasteners, snap-fit, friction-fit, adhesive, or any other form of clamshell housing fastening means. The housing 105 defines a first opening 110 and a second opening 115, sized and shaped to respectively axially receive output 120 and input 125. The output 120 and input 125 can be rotatably coupled within the first opening 110 and the second opening 115 by a first clip 130 and a second clip 135, respectively, and are rotatable relative to the housing 105. In some embodiments, intermediate gears 140 can operatively couple the output 120 and the input 125 within the housing 105. The input 125 can receive torque from an external tool, e.g., a torque wrench or ratchet wrench, and the gears 140 cooperatively transfer the torque to the output 120 which can then apply the torque to a remote work piece via the driver 145, or an accessory coupled to the driver 145, such as a socket. A support 150 can be coupled to the tool 100 at the housing 105, and a base 155 can be coupled to the support 150 to provide structural stability during the remote wrench operation.

Figure 2:
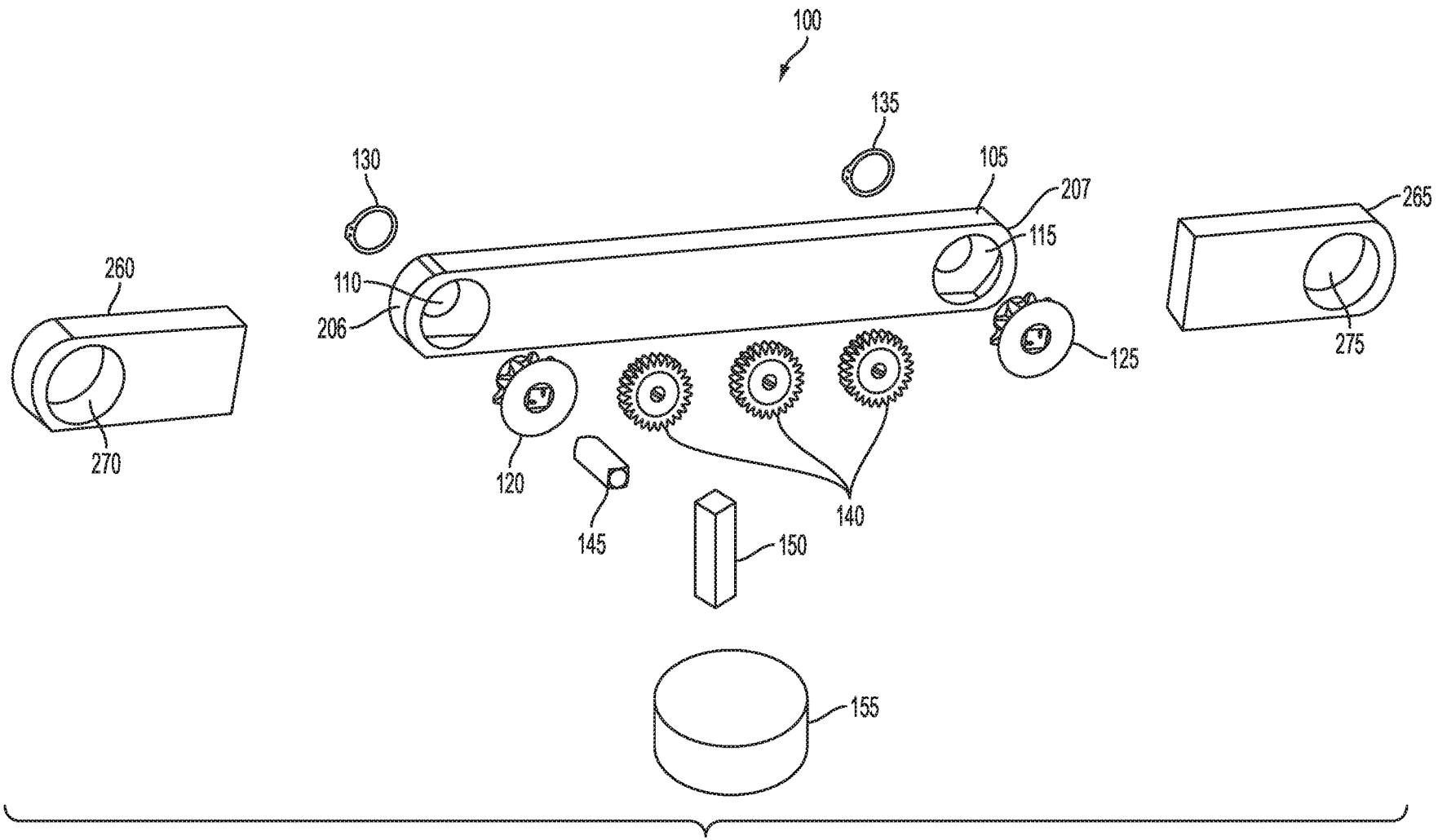
FIG. 2 is an exploded, side perspective view of another remote wrench according to an embodiment of the present invention.
Figure 3:
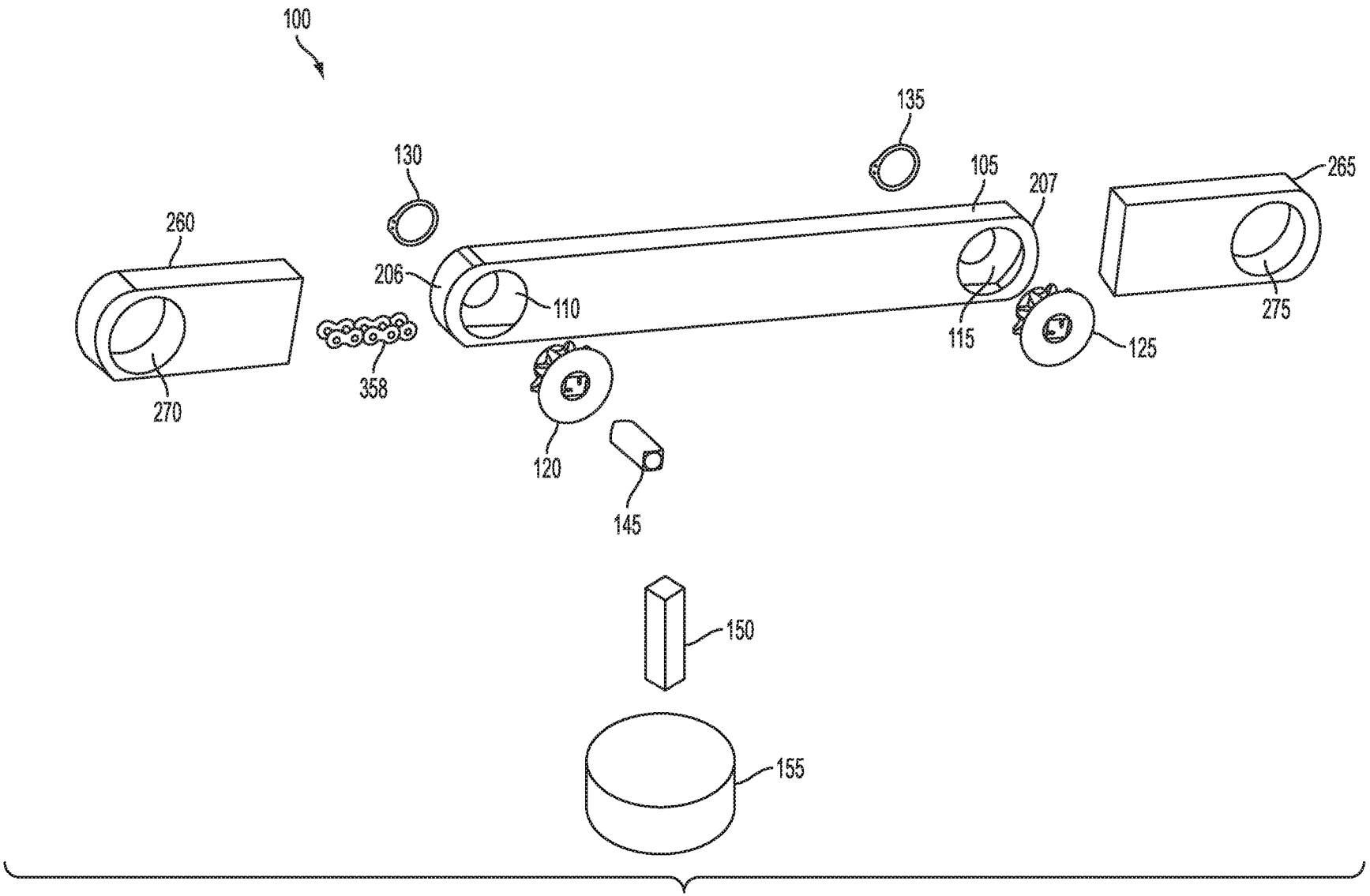
FIG. 3 is an exploded, side perspective view of another remote wrench according to an embodiment of the present invention.
Figure 4:
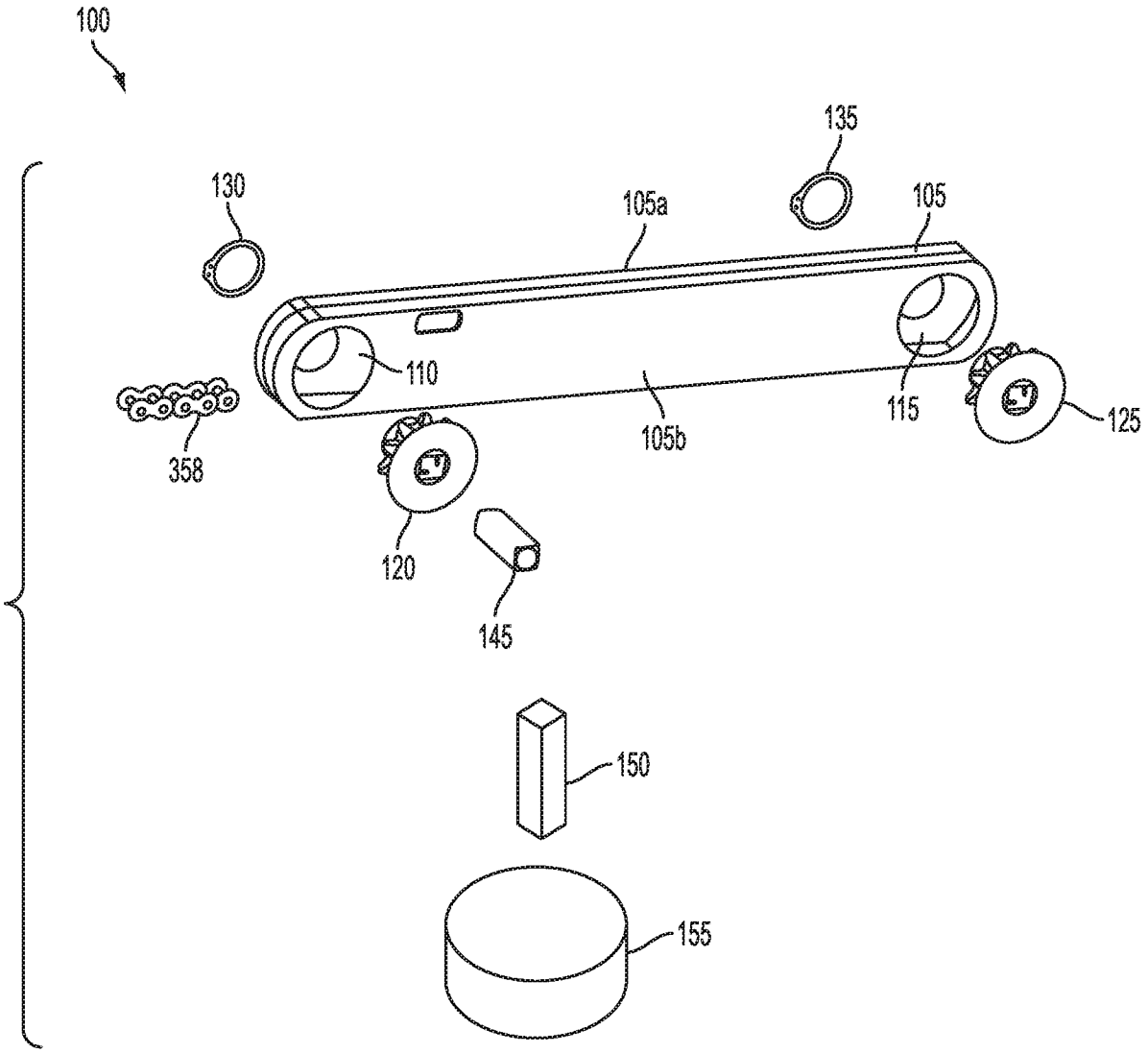
FIG. 4 is an exploded, side perspective view of another remote wrench according to an embodiment of the present invention.

The housing 105 can be any enclosure capable of housing the internal components of the tool 100, for example, the input 125, output 120, and the internal gears 140. As shown in FIGS. 1 and 4, in an embodiment, the housing 105 can be a clamshell type housing coupled together at a center axis to allow access to the internal components of the tool 100 after assembly. The housing 105 can also be a singular body with side openings 206, 207 at the respective lateral ends of the housing 105, as shown in FIGS. 2 and 3. The singular body housing 105 resists failure from torsion and torque stresses by omitting seams inherent with conventional clamshell housings 105, as shown in FIGS. 1 and 4, while still allowing access to the internal components of the housing 105 after assembly for maintenance, repair, or assembly, via side openings 206, 207. In will be appreciated that any other housing can be implemented without departing from the spirit and scope of the present application.

The input 125 functions as the input mechanism for the tool 100 and receives torque from an external source, e.g., a torque or ratchet wrench or other suitable torque application tool. For example, a user can insert a lug driver of a torque or ratchet wrench or other suitable tool into input 125 and apply a torque to the tool 100. In an embodiment, the input 125 and output 120 can be operably coupled gears, and as such, the input 125 can transfer the input torque to the output 120 via the cooperative intermediate gears 140 as shown in FIGS. 1 and 2. Alternately, the input 125 and output 120 can be sprockets, and as such, the input 125 can transfer the input torque to the output 120 via a chain 358, as shown in FIGS. 3 and 4.

In an embodiment, the output 120 can include a driver 145, similar in shape and size to a typical driver of the torque wrench or other tool, and can apply torque to an accessory (such as a socket that can be coupled to a work piece). The driver 145 can be permanently or releasably coupled to the output 120, and can be inserted into either or both of the input 125 and output 120, in some embodiments.

Referring to FIGS. 2 and 4, the input 125 and output 120 can be gears operatively coupled together via cooperative intermediate gears 140. The input 125, output 120, and intermediate gears 140 can be any type of gear or gear train, such as a planetary gear train, in-line gear train, spur gears, bevel gears, rack and pinion gears, worm gears, or any combination of the above. The intermediate gears 140 can also be any number of gears, and are not limited to the three gear embodiment shown in FIGS. 1 and 2. In some embodiments, the input 125 is directly connected to the output 120 with no intermediate gears 140 or chain 358. In an embodiment, the input 125, output 120, and intermediate gears 140 are a five gear in-line spur gear train. It will be appreciated that the torque transfer mechanism between the input 125 and output 120 can be anything that transfers torque therebetween.

The clips 130, 135 can be any structure capable of clipping onto the input 125 and output 120 and rotatably retaining the input 125 and output 120 respectively within the first opening 110 and second opening 115. In an embodiment, the clips 130, 135 are spring metal clips that engage circumferential grooves disposed on the input 125 and output 120 to retain the input 125 and output 120 within the openings 110, 115.

The first 206 and second 207 side openings can be respectively enclosed by first 260 and second 265 covers. The covers 260, 265 can respectively include first 270 and second 275 cover openings to respectively allow for access to the output 120 and input 125. In an embodiment, the covers 260, 265 are made of a flexible material (e.g., rubber or other type of polymer) such that the covers 260, 265 can easily slide over the side openings 206, 207 and removed without requiring a special tool.

Figure 5:
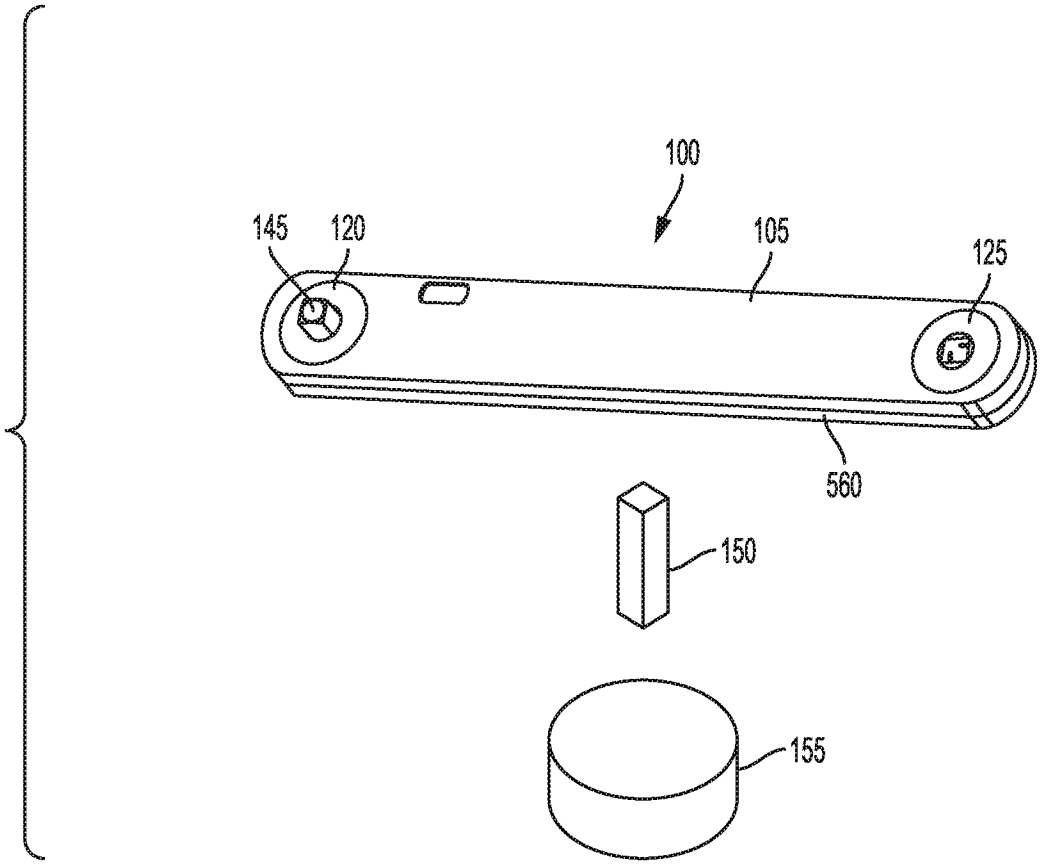
FIG. 5 is an exploded, side perspective view of a housing, support, and base according to an embodiment of the present invention.
Figure 6:
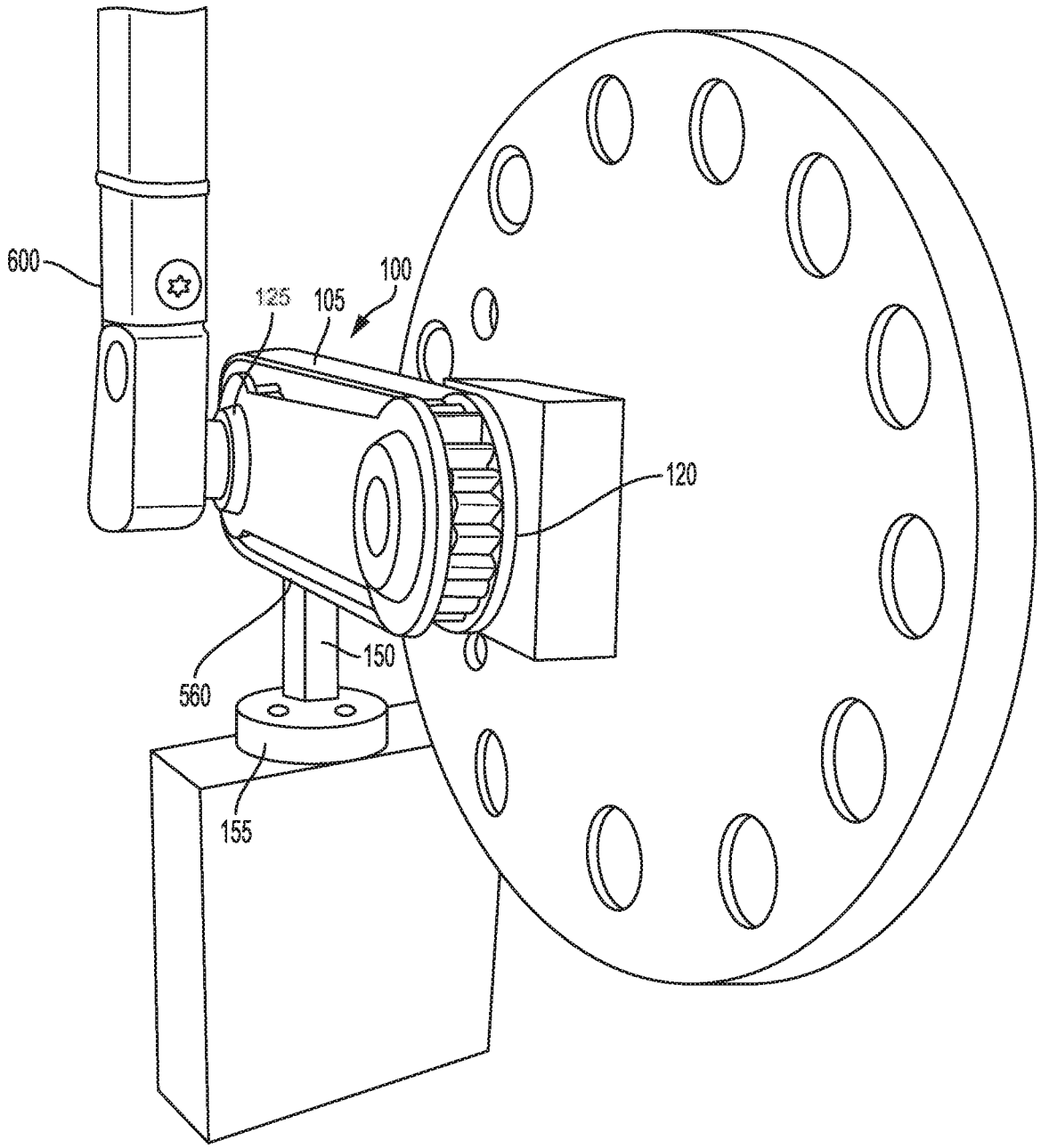
FIG. 6 is an exploded, side perspective view of an assembled remote wrench according to embodiments of the present invention.

The support 150 can be any structure capable of contacting the housing 105, and similarly, the base 155 can be any structure capable of providing structural stability for the support 150. As shown in FIGS. 5 and 6, the support 155 can contact a plate 560 within the housing 105. The plate 560 can be a flexible structure (e.g., more flexible than the remainder of the housing 105, or more flexible than the input 125, output 120, intermediate gears 140, and/or driver 145) to provide for a flexible surface for the support 155 to couple with. For example, the plate 560 can be a first portion of the housing 105 having a first stiffness, and the remainder of the housing 105 can be a second portion of the housing 105 having a second stiffness greater than the first stiffness. In another embodiment, the support 150 can be an elastically-biased member, e.g. a spring-biased member, to provide additional elasticity to the tool 100. The support 150 can also include a grip for gripping the housing 105 and improving the coupling between the support 150 and the housing 105.

As discussed above, the inventors of the present invention discovered that implementing a flexible plate 560 within or against the housing allows for greater torque transfer efficiency between the input 125 and output 120 in the remote torque application. Similarly, implementing a support 150 with a base 155, and contacting the support 150 at the flexible plate 560, further improves the remote torque application efficiency, compared to a rigid housing 105 and rigid support 150. Either the flexible plate 560 can be implemented alone, or in combination with the support 150 and base 155, or the support 150 and base 155 can be implemented without the flexible plate 560.

For example, the above structure improves torque transfer efficiency by allowing a user to rotate a ratchet wrench or other torque input tool by a greater angle per iteration of torque application. For example, when using a ratchet wrench to apply torque to input 125, the user must rotate the ratchet wrench while it is connected to the remote wrench. The remote wrench may be located at an angle to the ratchet wrench such that it is difficult to substantially rotate the ratchet wrench without holding or otherwise supporting the remote wrench. The present invention allows for greater maneuverability of the ratchet wrench or input torque tool 600 by providing a support 150 and base 155 to provide greater structural stability for the remote wrench during the torque application process. Also, by applying a flexible plate 560, and optionally connecting the support 150 and base 155 to the flexible plate 560, the present invention allows for more flexibility in the torque application process and, therefore, allows greater rotations of the input tool for each iteration of torque input.

As discussed above, the tool 100 can be a remote wrench. However, the tool 100 can be any tool or object, for example, a remote wrench, impact wrench, torque wrench, or other suitable object. The tool 100 need not be a tool at all, and can instead be a piece of sporting equipment, industrial equipment, office equipment, or other type of object that requires a housing.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A torque application tool comprising:

a housing having opposing first and second ends with respective first and second apertures, first and second housing portions coupled together, and a housing longitudinal axis, the first and second housing portions having respective first and second stiffnesses, wherein the second stiffness is greater than the first stiffness;

a flexible plate coupled to a lateral side of the housing, wherein the flexible plate is more flexible than the housing, and an input disposed in the first aperture and being rotatable relative to the housing and adapted to receive torque;

an output disposed in the second aperture and being rotatable relative to the housing and operatively coupled to the input to receive torque from the input; and a support coupled to the lateral side of the housing between the first and second ends and contacting the flexible plate, the support having a support longitudinal axis that extends from the housing substantially perpendicular to the housing longitudinal axis, wherein the support is adapted to provide structural stability to the torque application tool during use.

2. The tool of claim 1, further comprising a base coupled to the support opposite the housing.

3. The tool of claim 1, further comprising first and second sprockets respectively coupled to the input and output.

4. The tool of claim 3, wherein the first and second sprockets are operably coupled together by a chain.

5. The tool of claim 1, further comprising first and second gears respectively coupled to the input and output.

6. The tool of claim 5, wherein the first and second gears are operably coupled with a gear train.

7. The tool of claim 1, wherein the input includes a receiving portion.

8. The tool of claim 1, wherein the output includes a drive.

9. The tool of claim 1, wherein the housing further includes a first side opening, and further comprising a first cover that encloses the first side opening.

10. The tool of claim 9, wherein the housing further includes a second side opening, and further comprising a second cover that encloses the second side opening.

11. The tool of claim 1, wherein the support is an elastically-biased member.

12. The tool of claim 1, wherein the support includes a grip.

13. A method of applying torque to a work piece comprising:

providing a tool having a housing with opposing first and second ends with first and second housing portions coupled together, the housing having a housing longitudinal axis, the first and second housing portions having respective first and second stiffnesses, wherein the second stiffness is greater than the first stiffness, a flexible plate coupled to a lateral side of the housing, wherein the flexible plate is more flexible than the housing, and the tool includes an input adapted to receive a torque and transfer the torque to an output, the output further adapted to transfer a least a portion of the torque to the work piece;

coupling a support to the lateral side of the housing, the support having a support longitudinal axis extending from the housing substantially perpendicular to the housing longitudinal axis and adapted to provide structural stability to the tool during use, wherein the support abuts the flexible plate; and applying the torque to the input, thus causing at least a portion of the torque to be transferred from the input to the output.

14. The method of claim 13, wherein the support is an elastically-biased member.

15. The method of claim 13, wherein the support includes a grip.

* * * * *